US005383606A

United States Patent [19]

Stegmaier et al.

[11] Patent Number: 5,383,606

[45] Date of Patent: Jan. 24, 1995

[54] FUEL INJECTION VALVE AND METHOD FOR ADJUSTING A FUEL INJECTION VALVE

[75] Inventors: Alwin Stegmaier, North Charleston, S.C.; Kenneth J. Zwick, Philadelphia, Pa.

[73] Assignee: Robert Bosch GmbH, Stuttgart, Germany

[21] Appl. No.: 906,908

[22] Filed: Jun. 30, 1992

[30] Foreign Application Priority Data

Jul. 18, 1991 [DE] Germany ..... 4123787

[51] Int. Cl.[6] ..... F02M 61/16; F02M 55/00

[52] U.S. Cl. ..... 239/575; 239/580; 239/585.1; 239/900

[58] Field of Search ..... 239/575, 580, 582.1, 239/585.1, 585.4, DIG. 23, 900

[56] References Cited

U.S. PATENT DOCUMENTS

| | | | |
|---|---|---|---|
| 3,540,660 | 11/1970 | Simon | 239/580 X |
| 4,281,797 | 8/1981 | Kimata et al. | 239/575 X |
| 4,548,356 | 10/1985 | Hofmann et al. | 239/575 X |
| 4,903,898 | 2/1990 | Kind . | |
| 4,915,350 | 4/1990 | Babitzka et al. . | |
| 5,156,342 | 10/1992 | Takeda et al. | 239/585.1 X |
| 5,165,656 | 11/1992 | Maier et al. | 239/585.4 X |

FOREIGN PATENT DOCUMENTS

| | | | |
|---|---|---|---|
| 0282463 | 9/1988 | European Pat. Off. . | |
| 217249 | 2/1961 | Germany | 239/585.4 |
| 3533521 | 4/1987 | Germany . | |
| 3640830 | 6/1988 | Germany . | |
| 3831196 | 3/1990 | Germany . | |
| 56-81255 | 3/1981 | Japan . | |
| 1440002 | 6/1976 | United Kingdom | 239/585.1 |

*Primary Examiner*—William Grant

*Attorney, Agent, or Firm*—Edwin E. Greigg; Ronald E. Greigg

[57] ABSTRACT

A fuel injection valve and method for adjusting the static fuel quantity output ejected during the steady opening state of the fuel injection valve. In the method according to the invention, the static fuel quantity is adjusted directly in the otherwise completely installed fuel injection valve, so that a variation on the static fuel quantity of the various fuel injection valves is minimized. To this end, a throttle device, serving to meter the fuel and whose free flow cross section is variable, is provided upstream of the valve seat. The method according to the invention is suitable for fuel injection valves of various kinds.

11 Claims, 1 Drawing Sheet

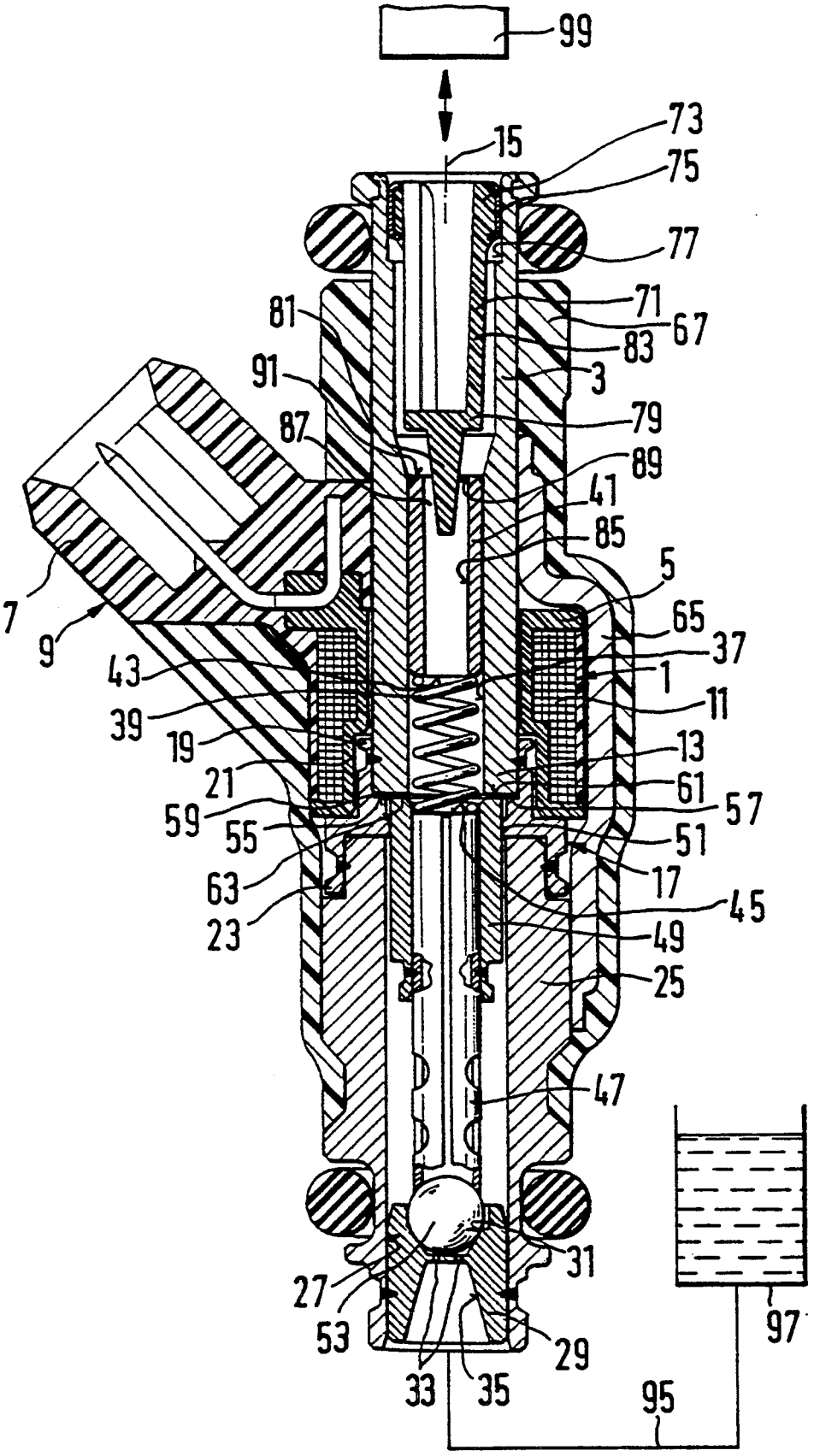
99
15
73
75
77
71
67
83
3
81
91
87
79
89
41
85
5
7
9
65
37
43
1
11
39
19
13
21
61
59
57
55
51
63
17
23
45
49
25
47
31
27
53
29
33
35
95
97

FUEL INJECTION VALVE AND METHOD FOR ADJUSTING A FUEL INJECTION VALVE

BACKGROUND OF THE INVENTION

The invention is directed to a fuel injection valve and a method for adjusting the static fuel quantity, ejected during the steady opening state, of a fuel injection valve.

In the fuel injection valve known for example from German Patent Disclosure Document DE 35 33 521 A1, the stroke of the valve closing body and thus the static flow quantity of a fluid output ejected during the steady opening state of the fuel injection valve, is adjusted in that the end face of the nozzle body on which the stop plate that defines the remanent air gap of the armature with respect to the core is ground down. However, this valve and the adjusting method employed has the disadvantage that the end face of the nozzle body can be ground down only after the valve has been partly dismantled, making it very difficult and complicated to adjust the valve needle stroke exactly.

A fuel injection valve having a valve seat body that has at least one injection port is described in German Patent Disclosure Document DE 38 31 196 A1. The valve seat body is pressed into the longitudinal opening of the nozzle holder, and the depth to which it is pressed defines the valve needle stroke. Although the valve needle stroke can be adjusted in the completely installed injection valve, nevertheless the danger of chip formation at the valve seat body and/or the seat holder when the valve seat body is pressed into the nozzle holder still exists.

In the perforated plate-type fuel injection valve, known for instance from German Patent Disclosure Document DE 36 40 830 A1, the injection ports of the perforated plate have predetermined opening cross sections that vary the static fuel quantity. To adjust the static fuel quantity, the exact flow quantity through individual perforated plates is measured in order to combine a perforated plate with a particular valve group that has a known valve stroke. Then the fuel injection valve is installed and provided with a fuel filter, but the danger exists that the static fuel quantity of the valve will be undesirably changed in the process.

An electromagnetically actuatable fuel injection valve has also been proposed, the tubular inner pole of which has a throughbore extending concentrically with a longitudinal valve axis. An adjusting bush that serves to adjust the restoring spring is pressed into this throughbore, and a fixed, nonadjustable throttle body is disposed in the longitudinal opening of this adjusting bush.

OBJECT AND SUMMARY OF THE INVENTION

It is a principal object of the invention to provide a method for adjusting the static fuel quantity output ejected during the steady opening state, of a fuel injection valve, having the advantage of a simple, economical adjustment of the static fuel quantity in the otherwise completely installed fuel injection valve. Adjusting the otherwise completely installed fuel injection valve makes it possible to adhere particularly accurately to the required static fuel quantity, without there being the danger that the actual static fuel quantity may be changed by some ensuing operation, such as the installation of a fuel filter. It is accordingly assured that the mass-produced fuel injection valves will have particularly little variation in terms of the static fuel quantity, and that the same fuel quantity will for instance be metered to the various cylinders of an internal combustion engine.

It is a further object to provide a fuel injection valve which follows that method.

It is also possible to reduce the number of variants of the fuel injection valves, since the fuel injection valves according to the invention, because they can be adjusted in an otherwise completely installed state, can be used for various injection quantities.

To assure particularly exact adjustment of the static fuel quantity, it is advantageous if the free cross section of the throttle device is continuously variable.

It is advantageous if the static fuel quantity of a fuel injection valve that has a tubular inner pole, a flow bore extending concentrically with a longitudinal valve axis, and a throttle body, is adjustable in that the free cross section of the throttle device is variable by varying the depth to which the throttle body is inserted into the flow bore of the inner pole.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows a fuel injection valve in accordance with the exemplary embodiment.

DESCRIPTION OF THE PREFERRED EMBODIMENT

The drawing shows a fuel injection valve for injection systems of mixture-compressing internal combustion engines with externally supplied ignition, by way of example. The fuel injection valve has an inner pole 3, serving as a fuel inlet neck and surrounded by a magnet coil 1. The magnet coil 1, with a magnet coil body 5, is provided with an extruded plastic coat 7, and an electrical connection plug 9 is extruded jointly at the same time, thereby producing an independent plastic molded part that contains both the magnet coil 1 and the connection plug 9. In combination with the inner pole 3, which has a constant outside diameter, the radially stepped coil body 5, with its magnet coil 1 having a radially stepped winding 11, makes a particularly compact structure of the fuel injection valve possible.

A tubular intermediate part 17 is tightly joined, for instance by welding, to a lower pole end 13 of the inner pole 3, concentrically with a longitudinal valve axis 15, and as a result fits partway over the pole end 13 axially with an upper cylindrical segment 19. The stepped coil body 5 partly extends over the inner pole 3, and with a step 21 of larger diameter it fits over the upper cylindrical portion 19 of the intermediate part 17. The intermediate part 17, on its end remote from the inner pole 3, is provided with a lower cylindrical segment 23, which fits over a tubular nozzle holder 25 and is joined to the tubular nozzle holder, for instance by welding. A cylindrical valve seat body 29 is tightly installed by welding in the downstream end of the nozzle holder 25, in a through opening 27 extending concentrically with the longitudinal valve axis 15. Toward the magnet coil 1, the valve seat body 29 has a fixed valve seat 31, downstream of which are injection ports 33 in the valve seat body 29, for instance two in number, which are shaped by erosion. The injection ports 33 have such large opening cross sections that the actual quantity of fuel output ejected during the steady opening state of the fuel injection valve exceeds the predetermined set-point quantity, unless a further throttle device for metering the fuel is provided. The valve seat body 29 has a preparation bore 35, widening frustoconically in the flow direction, downstream of the injection ports 33.

To adjust the spring force of a restoring spring 39, a tubular adjusting bush 41 is pressed into a stepped flow bore 37 of the inner pole 3 that extends concentrically with the longitudinal valve axis 15. The restoring spring 39 rests by one end on the face end 43, toward the valve seat body 29, of the adjusting bush 41. The depth to which the adjusting bush 41 is pressed into the flow bore 37 of the inner pole 3 determines the spring force of the restoring spring 39 and thus also varies the dynamic fuel quantity output during the opening and closing strokes of the valves.

The restoring spring 39 is supported by its end remote from the adjusting bush 41, in the downstream direction, on a face end 45 of a connecting tube 47. A tubular armature 49, which is guided by a guide collar 51 of the intermediate part 17, is joined to the end of the connecting tube 47 toward the restoring spring 39, for instance by welding. A valve closing body 53, for instance embodied as a ball and cooperating with the fixed valve seat 31 of the valve seat body 29, is joined to the other end of the connecting tube 47, for instance by welding.

An axial gap 59 is formed between a face end 55 of the pole end 13 toward the armature 49 and a shoulder 57, leading to the upper cylinder segment 17, of the intermediate part 17; a non-magnetic stop shim 63, that limits the stroke of the valve closing body 53 in the opening process of the valve and forms a remanent air gap between an inlet-side face end 61 of the armature 49 and the face end 55 of the pole end 13, is disposed in the axial gap 59 by being wedged in place.

The magnet coil 1 is surrounded by at least one guide element 65, for instance embodied as a hoop and serving as a ferromagnetic element, which at least partially surrounds the magnet coil 1 circumferentially and with one end rests on the inner pole 3 and with its other end rests on the nozzle holder 25, to which it is joined by welding or soldering, for example. Part of the fuel injection valve is enclosed by a plastic sheath 67, which extends from the inner pole 3 axially over the magnet coil 1 and the at least one guide element 65.

A fuel filter 71 is disposed in the stepped flow bore 37 of the inner pole 3, upstream of the adjusting bush 41, in the direction remote from the pole end 13. The fuel entering the fuel injection valve flows through the fuel filter 71 in a known manner and emerges radially from the fuel filter, and any contaminants in the fuel are retained in the fuel filter 71. The fuel filter 71 has a retaining ring 75 on the periphery of its upper end 73 remote from the pole end 13. The fuel filter 71 can be installed by being pushed into the stepped flow bore 37 of the inner pole 3, and in the installed state it rests with its retaining ring 75 pressing radially slightly against the wall of a parallel segment 77 of the stepped flow bore 37 remote from the lower pole end 13.

A lower end 79, toward the lower pole end 13 of the inner pole 3, of a support part 73 supporting the filter cloth of the fuel filter 71 is joined to a throttle body 81 that extends in the direction of the longitudinal valve axis 15, toward the restoring spring 39. The throttle body 81 may for example be embodied as a plastic component and be jointly formed on the support part 83 of the fuel filter 71 by being molded on, and can be produced simply and economically in this way. The throttle body 81 has a shape that tapers frusto-conically in the flow direction, for instance, or in other words toward the valve seat 31. Instead of this shape, the throttle body 81 may for instance have the form of a tetrahedron, or a pyramid, or some other shape that preferably tapers in the fuel flow direction.

The adjusting bush 41 has a cylindrical longitudinal opening 85 that extends in the flow direction of the fuel concentrically with the longitudinal valve axis 15; the fuel flows through this opening 85 in the direction of the valve seat 31 of the fuel injection valve. The throttle body 81 tapering frustoconically in the flow direction protrudes partway into the longitudinal opening 85 of the adjusting bush 41, for example, so that a throttle device 87 is formed between the periphery of the throttle body 81 and the wall of the longitudinal opening 85. The throttle device 87 has a narrow, annular free flow cross section 89, which at its narrowest point, in the region of the upper end face 91 toward the fuel filter 71 of the adjusting bush 41, serves to meter the fuel, and whose cross-sectional area influences the static fuel quantity of the fuel injection valve output ejected during the steady opening state.

To adjust the static quantity of fuel output ejected during the steady opening state by the fuel injection valve, the actual quantity of the output fuel when the fuel injection valve is fully opened is measured in the otherwise completely installed fuel injection valve, that is the fuel injection valve is installed within the valve housing, not the fuel injection system of a vehicle, for instance by means of a fuel line 95 and a fuel collection vessel 97. The injection ports 33 in the fuel injection valves shown by way of example have such large opening cross sections that the actual quantity of the output fuel is also greater than the predetermined static set-point quantity. In a second method step of the invention, the depth of insertion of the fuel filter 71 in the flow bore 37 of the inner pole 3 and thus the depth to which the throttle body 81, tapering frustoconically in the flow direction, protrudes into the longitudinal opening 85 of the adjusting bush 41, is varied with a tool 99 until such time as the narrow free flow cross section 89, which meters the fuel, on the upper face end 91 of the adjusting bush 41 between the periphery of the throttle body 81 and the wall of the longitudinal opening 85 of the adjusting bush 41 has changed to such an extent that the output actual quantity matches the predetermined static set-point quantity of the fuel. In this way, the free flow cross section 89 of the throttle device 87 and hence the static fuel quantity of the injection valve output ejected during the steady opening state can be varied continuously until the correct quantity passes through the valve seat opening, the fuel filter 71 and thus the throttle body 81 joined to the fuel filter 71 can be displaced during the injection process, both in the fuel flow direction and in the direction opposite to it.

It is also possible for the throttle device 87 to be formed between the throttle body 81 and the wall of the stepped flow bore 37 of the inner pole 3.

The method of the invention has the advantage that the static fuel quantity output ejected during the steady opening state can be adjusted directly in an otherwise completely installed fuel injection valve. As a result, not only is the variation in the static fuel quantities of the various fuel injection valves minimized, but at the same time a reduction in production costs is attained.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for adjusting a static fuel quantity output ejected during a steady opening state of a fuel injection valve that has a valve closing part located in a flow conduit and cooperating with a valve seat and a throttle device disposed upstream of the valve seat and serving to meter the fuel, comprising the steps of:

measuring an actual quantity of the ejected output fuel in a complete fuel injection valve while the fuel injection valve is completely opened to permit a fuel flow through the opened valve, comparing the measured ejected output with a predetermined set-point measured quantity, and continuously varying the free flow cross section (89) of the throttle device (87) until the ejected output of an actual quantity matches the predetermined set-point quantity of the fuel.

2. A method as defined by claim 1, wherein the fuel injection valve for performing the method steps further includes a tubular inner pole, having a flow bore extending concentrically with a longitudinal valve axis, and a throttle body, in which the free cross section (89) of the throttle device (87) is varied by varying a depth of insertion of the throttle body (81) into the flow bore (37) of the inner pole (3).

3. A fuel injection valve having a valve closing element located in a flow conduit and cooperating with a valve seat, a throttle device disposed upstream of the valve seat and serving to meter the fuel flow, and a free cross section (89) of the throttle device (87) is continuously variable in an otherwise complete fuel injection valve whereby the flow of fuel is adjusted to a predetermined flow quantity.

4. A fuel injection valve as defined by claim 3, having a tubular inner pole, having a flow bore extending concentrically with a longitudinal valve axis, and having a throttle body, in which the free cross section (89) of the throttle device (87) is variable by varying a depth of insertion of the throttle body (81) in the flow bore (37) of the inner pole (3).

5. A fuel injection valve as defined by claim 4, having a fuel filter (71) disposed in the flow bore of the inner pole, in which the throttle body (81) is joined to the fuel filter.

6. A fuel injection valve as defined by claim 5, in which the throttle body (81) tapers in the fuel flow direction.

7. A fuel injection valve as defined by claim 4, in which the throttle body (81) tapers in the fuel flow direction.

8. A fuel injection valve having a valve closing element located in a flow conduit which cooperates with a valve seat, a tubular inner pole (3), a flow bore (37) extending through said inner pole concentrically with a longitudinal valve axis, a tubular adjustable bush (41) disposed within the flow bore of the inner pole and having a longitudinal opening (85), a fuel filter (71) disposed in said flow bore (37) of the inner pole upstream of said tubular adjusting bush, said fuel filter having a throttle body (81) joined to a lower end thereof, said throttle body (81) protrudes partway into said longitudinal opening of said tubular adjustable bush to form a throttle device (87) having a free cross section (89), said free cross section is variable by varying a depth of insertion of said filter into said tubular inner pole simultaneously with varying a depth of insertion of the throttle body (81) into the longitudinal opening (85) of the tubular adjustable bush.

9. A fuel injection valve as defined by claim 8, in which the throttle body (81) tapers in the fuel flow direction.

10. A fuel injection valve having a valve closing element located in a flow conduit and cooperating with a valve seat, a throttle device disposed upstream of the valve seat and serving to meter the fuel flow, and a free cross section (89) of the throttle device (87) is continuously variable in an otherwise complete fuel injection valve having a tubular inner pole, a flow bore extending concentrically with a longitudinal valve axis, a fuel filter (71) disposed in the flow bore of the inner pole, a throttle body joined to the fuel filter, in which the free cross section (89) of the throttle device (87) is variable by varying a depth of insertion of the throttle device (81) in the flow bore (37) of the inner pole (3), a tubular adjusting bush disposed in the flow bore of the inner pole, the bush having a longitudinal opening and being disposed downstream of the fuel filter, in which the throttle body (81) protrudes part way into the longitudinal opening (85) of the adjusting bush (41).

11. A fuel injection valve as defined by claim 10, in which the throttle body (81) tapers in the fuel flow direction.

* * * * *